United States Patent [19]

Johnson

[11] Patent Number: 4,571,872

[45] Date of Patent: Feb. 25, 1986

[54] DEVICE FOR ATTACHING A FRONT SLING-RECEIVING LOOP TO A WEAPON

[76] Inventor: David A. Johnson, 3432 Tanglewood Way, Salem, Oreg. 97302

[21] Appl. No.: 648,451

[22] Filed: Sep. 6, 1984

[51] Int. Cl.[4] ..... F41C 23/02

[52] U.S. Cl. ..... 42/85; 224/150; 224/913

[58] Field of Search ..... 42/85, 86, 1 S; 33/233; 24/2.5, 643; 224/150, 913

[56] References Cited

U.S. PATENT DOCUMENTS

| | | | |
|---|---|---|---|
| 1,002,115 | 8/1911 | Barnes | 42/86 |
| 1,121,589 | 12/1914 | Johnson | 42/86 |
| 1,260,021 | 3/1918 | Otterson | 42/86 |
| 3,066,375 | 12/1962 | Knowles et al. | 42/85 |
| 3,742,636 | 7/1973 | Dealy et al. | 42/1 S |
| 4,454,675 | 6/1984 | Ives | 42/85 |
| 4,505,012 | 3/1985 | Johnson | 42/85 |

*Primary Examiner*—Charles T. Jordan
*Attorney, Agent, or Firm*—Chernoff, Vilhauer, McClung, Birdwell & Stenzel

[57] ABSTRACT

An assembly for fastening a sling to the front portion of a military rifle or other shoulder weapon in an orientation facilitating carrying such a weapon at the carrier's side in an upright orientation, with the longitudinal axis of the weapon generally horizontal. A main body includes a forked end which fits on a bayonet lug and a bored opposite end which can be attached in a sling swivel mounting position on the weapon. A rotatable pedestal holds a sling swivel on one side of the weapon, where it is rotatable and pivotable about different axes. A second sling swivel can also be installed to one form of the assembly in the conventional military orientation. The construction of the assembly can be integrated into the structure of a front sight assembly.

17 Claims, 7 Drawing Figures

DEVICE FOR ATTACHING A FRONT SLING-RECEIVING LOOP TO A WEAPON

BACKGROUND OF THE INVENTION

The present invention relates to firearms, and particularly to a device for attaching a sling to the barrel of a shoulder weapon.

In order to be able to use a shoulder weapon such as a rifle, grenade launcher, or the like as quickly as possible, yet have freedom to use their hands when not actually firing such a weapon, soldiers often prefer to carry such a weapon in a forwardly or laterally directed position, with the weapon in the upright attitude in which it is used, and its barrel approximately horizontal. This position is now known as a horizontal ready position.

Rifles, particularly military rifles, and military grenade launchers, have long been equipped with slings permitting them to be carried without encumbering the carrier's hands. Such slings are also useful in bracing the weapon during use, to achieve better control and aim. Such slings have conventionally been attached to the bottom of the forestock or barrel and buttstock of a military shoulder weapon to permit the weapon to be carried with the barrel pointing upward. Attachment of a sling at such a location is chosen at least partly because attachment of a sling at the top of the weapon might interfere with use of the weapon's sights.

A sling may be attached with its forward end looped around a sloping portion of a raised front sight assembly such as that of the M-16 rifle used by the armed forces of the United States. It would be preferred to have the front end of a sling attached to the weapon in some other fashion in order to avoid the possibility of the sling interfering visually with use of the sights. Leaving the front end of the sling attached to the usual front sling loop commonly called a sling swivel, however, does not ordinarily result in the weapon hanging stably in the horizontal ready position.

Usually the front sling loop of a military shoulder weapon is a simple loop of metal defining an opening wide enough to receive the flexible strap of the sling. This sling loop normally has a neck which is pivoted with respect to the weapon, about a horizontal transverse axis. The neck is attached to the weapon normally between a pair of ears extending downwardly beneath the barrel. For example, a pair of ears extend downwardly beneath the rear portion of the front sight of a military weapon of the M-16 type and its civilian counterpart, the AR-15 rifle.

Many weapons of the M-16 type have been manufactured and will remain in military use for the foreseeable future. What is needed, then, is a simply installed device to attach the front end of a sling to such a weapon securely, to convert the weapon for use of its sling to suspend the weapon in the desired horizontal ready position.

SUMMARY OF THE INVENTION

The present invention provides a device which can be used to attach a sling to a shoulder weapon, replacing the original front sling-receiving loop and attaching a sling at a location which is useful in supporting the weapon in a horizontal ready position. The device of the present invention is particularly adapted for use with the M-16 and AR-15 rifle and related weapons which include a bayonet-receiving lug located a short distance ahead of the usual front sling mount.

In a preferred embodiment of the invention a short body portion has a forked front end which fits securely around a narrow portion of the bayonet mount or similar lug, without interfering with use of the lug for its primary purpose. A rear end portion may be riveted in place in the location usually occupied by the neck of the normal military type of front sling loop. A pedestal is securely attached to the body of the device in a position centrally located along its length, and a sling loop of construction similar to the ordinary military front sling loop is mounted pivotably on the pedestal. Alternatively, the pedestal may be provided with an eye for receiving other types of sling loops.

In another embodiment of the invention, the body of the device includes a pair of side rails defining a central opening within which the neck of an ordinary sling-receiving strap loop may be located and held pivotably on a pin, giving the option of attaching the front end of the sling in either the conventional military orientation or in the orientation required for carrying the weapon in the horizontal ready position.

It is therefore a principal object of the present invention to provide a device for use in conveniently attaching the front end of a sling to a shoulder weapon to facilitate carrying the weapon in a horizontal ready position.

It is another important object of the present invention to provide a device for use in conveniently attaching the front end of a sling to a weapon, in either a conventional military configuration or a configuration facilitating carrying the weapon in a horizontal ready position.

It is an important feature of the present invention that it provides a device which can be attached to a shoulder weapon between a previously used sling mount and a lug such as that provided for use in securing a bayonet to a weapon, by the use of a single fastener.

It is another important feature of the present invention that it provides a point of attachment for a sling loop which permits the strap loop to swivel and pivot about two different axes of rotation, making a sling attached to the loop useful both for carrying a weapon in a horizontal ready position and for steadying the weapon during shooting.

It is a principal advantage of the present invention that it provides a device for attaching a sling to a shoulder weapon in a fashion which makes the sling more convenient and versatile than attachment in the conventional military configuration.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 2:
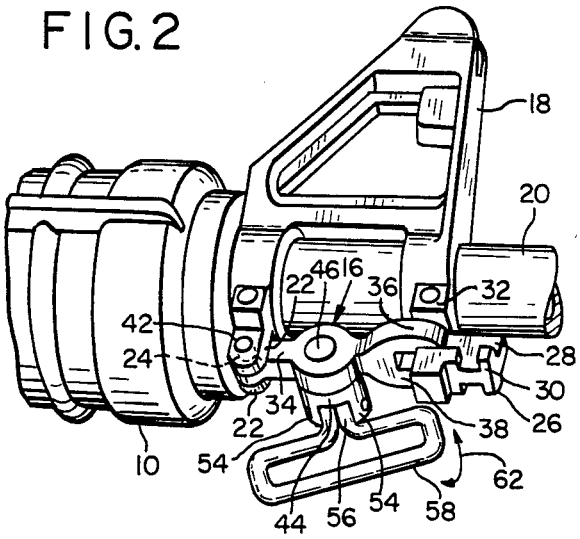
FIG. 2 is a perspective view of a portion of the shoulder weapon shown in FIG. 1, showing a portion of the lower right side of the barrel of the weapon, together with the device for attaching a sling to a weapon shown in FIG. 1, at an enlarged scale.

Referring now to the drawings, a shoulder weapon 10, which is of a type similar to the M-16 rifle utilized by the United States Armed Forces, is equipped with a sling 12 having a front portion 14 attached to the rifle 10 by a sling attachment assembly 16 embodying the present invention.

Figure 3:
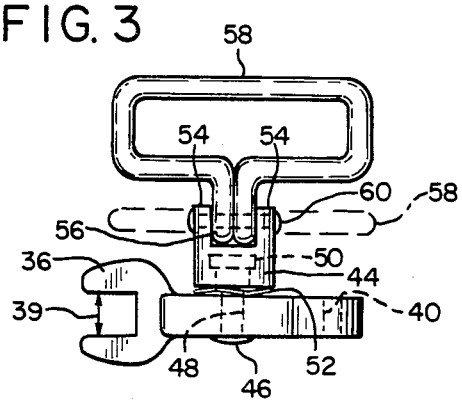
FIG. 3 is a bottom view of the sling attachment device shown in FIG. 1, at an enlarged scale.

As may be seen more clearly in FIGS. 2 and 3, the sling attachment assembly 16 is attached to the front sight assembly 18, which fits around the barrel 20 of the weapon 10 and is tightly clamped thereto. A bottom rear portion of the front sight assembly 18 includes a sling loop mount which comprises a pair of ears 22 which extend downwardly parallel with one another and spaced apart from one another by a distance sufficient to receive, ordinarily, the neck of a sling loop, in the conventional military position and orientation. Each of the ears 22 defines a transverse hole 24, the transverse holes 24 of the two ears 22 being aligned with one another to receive a pin, ordinarily, to hold a sling loop.

A lug 26 extends downwardly from the front portion of the sight assembly 18 and includes a central web 28 which extends vertically and longitudinally of the weapon 10 beneath the barrel 20 to receive the end of the handle of a bayonet when a bayonet is mounted on the weapon 10. A wider portion 30 of the lug is located beneath the central web 28, and a wider portion 32 of the sight assembly 18 is located above the central web. The central web 28 is directly ahead of the space between the ears 22, and separated from the ears 22 by a distance established by the structure of the sight assembly 18.

The sling attachment assembly 16 includes a body 34 which extends longitudinally below the underside of the barrel 20. The front end of the body 34 defines a fork having a pair of arms 36 and 38 which are spaced apart from each other in a plane which is horizontal when the rifle 10 is upright in a horizontal ready position. The arms 36 and 38 are separated from one another by a lateral distance 39 permitting the fork to fit snugly on the central web 28, and preferably have a thickness corresponding to the amount of space between the wider portions 30 and 32 of the front sight assembly 18. The length of the arms of the fork is chosen so that the fork does not interfere with use of the lug 26 to hold a bayonet.

At the opposite end of the body 34 is a transverse bore 40, which is preferably of the same size as the transverse holes 24. A fastener such as a rivet 42 extends through the transverse holes 24 and the transverse bore 40, securely holding the body 34 in position extending between the ears 22 and the lug 26. Preferably the rivet 42 is of a type which is easily installed, for example, a rivet having a solid body and a tubular end.

A pedestal 44 is attached to the body 34 by a swivel pin 46, which is preferably a rivet of the type including a shoulder to limit its insertion into a swivel pin bore 48 extending transversely through the body 34, as may be seen in FIGS. 2 and 3. The head 50 of the swivel pin 46 retains the pedestal 44 alongside the body 34, and a spring washer 52 is located on the swivel pin 46, between the pedestal 44 and the body 34, to prevent the pedestal 44 from rattling and yet permit it to rotate freely about an axis of rotation extending laterally with respect to the body 34. Alternatively, the swivel pin might be fixed to the pedestal 44 and rotatable within the swivel pin bore 48.

A pair of supporting legs 54 extend parallel with one another beyond the head 50 of the rivet 46, and receive between them the neck portion 56 of a sling loop 58, which defines an opening of a size adapted to receive the strap portion of the sling 12. A pivot pin 60, such as a roll pin or rivet, extends through holes provided in the supporting legs 54 and the neck 56 of the sling loop 58, permitting the sling loop 58 to be pivoted about the pivot pin 60. The pivot pin 60 defines an axis extending perpendicular to the axis of rotation of the pedestal 44 about the rivet 46, as indicated by the arrows 62, to the position shown in FIG. 3 in broken line.

Alternatively, the pivot pin 60 may be omitted, permitting a detachable sling loop (not shown) to be mounted through the bores provided in the supporting legs 54, or the pedestal may have a distal end defining a single pivot pin hole for receiving a detachable sling loop.

While normally the device 16 will be installed with the pedestal 44 on the left side of the weapon 10, it can simply be turned over to place the pedestal 44 on the right side of the weapon 10.

Figure 4:
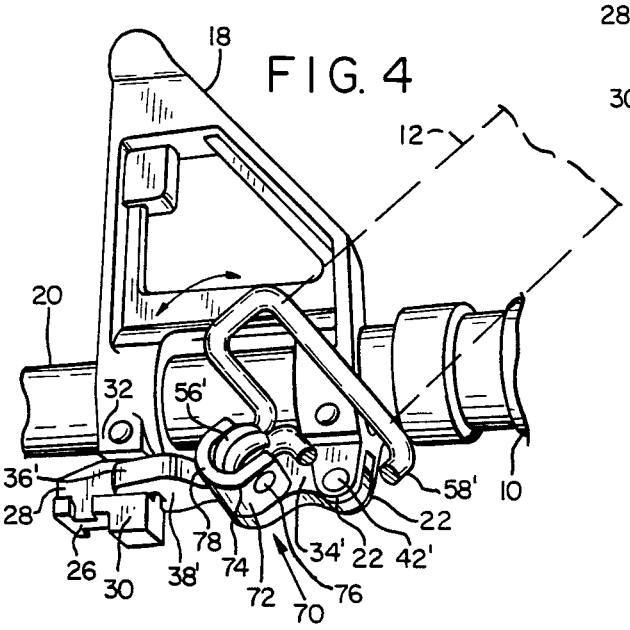
FIG. 4 is a perspective view taken from the left side of a shoulder weapon, showing the front sight and a device for attaching a sling which is an alternative embodiment of the present invention.

Referring now to FIG. 4, a sling attachment assembly 70, shown with the sight assembly 18, is similar in many respects to the sling attachment assembly 16. It includes a body 34' and a fork having arms 36' and 38'. It may be attached to the ears 22 by a rivet 42'. A pedestal 72, however, is fixedly, instead of rotatably, attached to the body 34', by welding or use of a fastener such as a rivet (not shown). The distal portion of the pedestal 72 includes a U-shaped yoke 74 and a pivot pin 76 extending through the yoke 74 from side to side to attach a sling loop 58' by extending through a corresponding hole in the neck portion 56' of the sling loop 58'. The top edge 78 of the yoke 74 limits the amount by which the sling loop 58' can rotate about the pivot pin 76, limiting it to pivoting between a position extending straight out from the weapon and a position extending upwardly alongside the front sight assembly 18, at a rearwardly inclined angle defined by the orientation of the yoke 74 with respect to the body 34'. The sling attachment assembly 70 is particularly intended for use with certain kinds of weapons, such as grenade launchers, where the possibility of the sling loop 58' being pivoted further downward might cause interference with use of the weapon in its intended manner.

Figure 5:
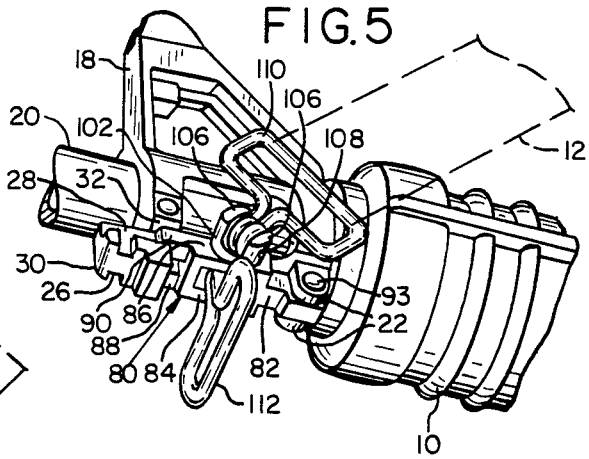
FIG. 5 is a perspective view of a portion of a weapon equipped with a device for attaching a sling which is yet another embodiment of the present invention.
Figure 6:
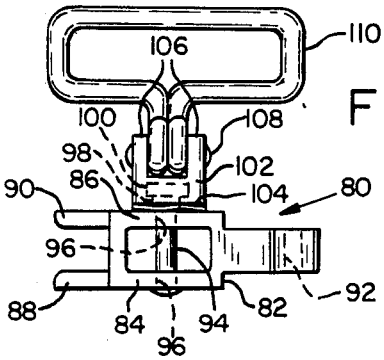
FIG. 6 is a bottom view of the sling attachment device shown in FIG. 5, at an enlarged scale.

Referring now to FIGS. 5 and 6, a sling attachment assembly 80 is a third embodiment of the invention. The sling attachment assembly 80 includes a body 82 having a pair of parallel side rails 84 and 86 and a fork including a pair of arms 88 and 90, located at one end of the body 82. At the other end of the body 82 is a transverse bore 92 which corresponds to the transverse bore 40 of the sling attachment assembly 16. A fastener such as a rivet 93 holds the rear end of the body 82 between the ears 22 of the front sight assembly 18, as with the previously described embodiments of the present invention.

A swivel pin 94 extends transversely through swivel pin bores 96 defined by the longitudinal side rails 84 and 86. As in the sling attachment assembly 16 the swivel pin 94 is preferably a shouldered rivet having an enlarged portion 98 and a head 100 to attach a pedestal 102, similar to the pedestal 44, to one side of the body 82, so that it can rotate about an axis of rotation extending along the swivel pin 94. A spring washer 104 is also preferably provided between the pedestal 102 and the side rail 86. A pair of supporting legs 106 which are part of the pedestal 102, and a pivot pin 108 attach a sling swivel 110 to the pedestal 102, so that the sling swivel 110 has the freedom to be rotated about the axis of rotation of the pedestal and about the swivel pin 108, to any desired orientation to facilitate carrying a weapon 10 in a horizontal ready position.

Figure 1:
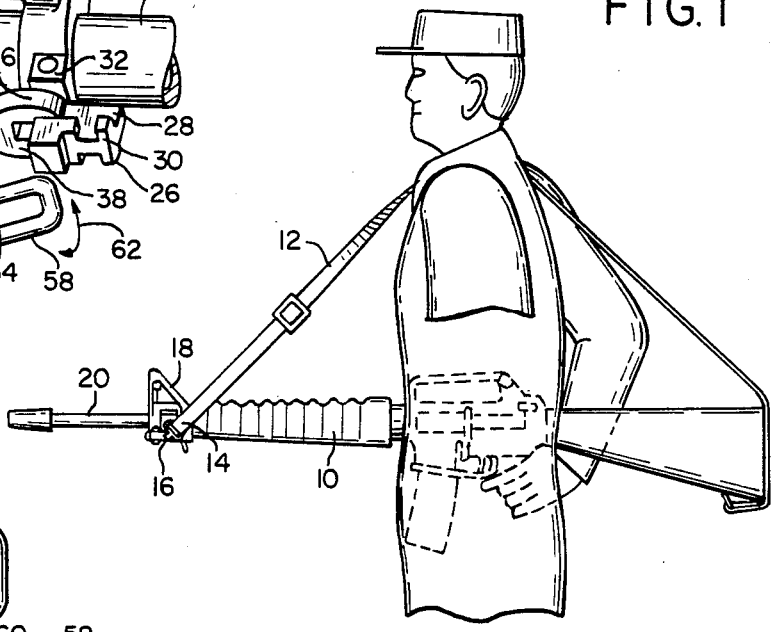
FIG. 1 is a view of a person carrying a shoulder weapon with which a device embodying the present invention is used to attach the front end of a sling to the weapon.

In addition, a sling loop 112 is pivotably attached in the position shown in FIG. 5, where it is pivotable about the swivel pin 94. The swivel pin 94 extends parallel with the usual axis of rotation of a sling loop mounted in the controversial military manner, as between the ears 22 of the sight assembly 18. Thus the sling attachment assembly 80 shown in FIGS. 5 and 6 provides the option of attachment of the sling 12 either in the conventional arrangement where it extends along the bottom of a weapon such as the rifle 10, or so that the sling 12 can be used to carry the weapon in the horizontal ready position shown in FIG. 1.

Installation of the sling attachment assemblies 16, 70 or 80 is essentially the same, requiring only that a preexisting sling loop, if any, be removed from its original position between the ears 22 of the front sight assembly 18. Thereafter the fork of the sling attachment assembly is slid into position on the lug 26 with the arms of the fork on respective sides of the central web 28 and the pedestal extending in the direction of the desired side of the weapon 10. The rear end of the body of the sling attachment assembly is then positioned with its transverse bore positioned between the transverse holes 24 of the ears 22 and a fastener such as the rivet 42 is installed.

This holds the sling attachment assemblies 16, 70, and 80 firmly in place, and can be quickly accomplished without any particular amount of skill.

Figure 7:
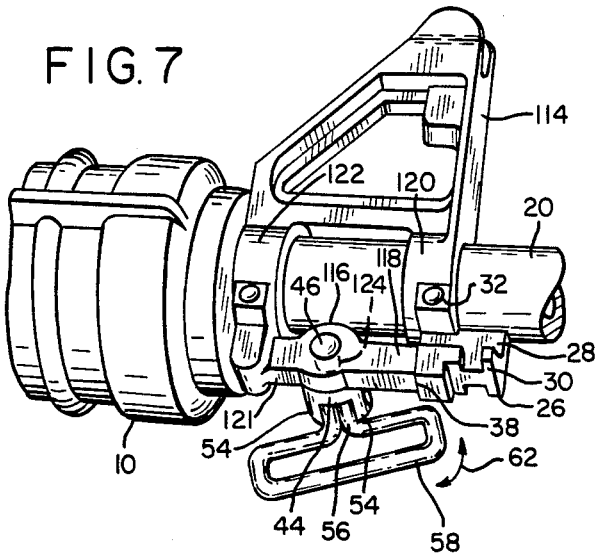
FIG. 7 is a perspective view of a portion of a shoulder weapon as in FIG. 2, showing a front sight assembly in which a sling-receiving loop is located on a side of the front sight assembly.

Alternatively, as shown in FIG. 7, the attributes of the invention can be provided in a sight assembly 114 which might replace the sight assembly 18 and is generally similar thereto, except for the provisions made for attachment of a sling loop thereto. An elongate bar-like body member 116 of the sight 114 includes a front end 118 which is an extension of the central web 28 extending downwardly beneath the front sight attachment collar 120. A rear end 121 is formed integrally with a part of the rear attachment collar 122 of the sight assembly. A swivel pin bore 124 receives a swivel pin 46 as in the sling attachment assembly 16 described previously, to hold a pedestal 44 and a sling loop 58 as in the sling attachment assembly 16.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A device for attaching a sling to a shoulder weapon having a front mount for a sling loop including a pair of laterally apart-spaced ears, each defining one of a pair of transverse holes colinearly aligned with each other, and having a lug placed longitudinally a predetermined distance apart from said mount, said lug including a vertical central web and a pair of wider portions located respectively above and below said central web, said device for attaching a sling comprising:

(a) an elongate body having a pair of opposite ends and a pair of opposite sides;

(b) a fork located at a first of said opposite ends, said fork including a pair of arms separated laterally from one another a distance great enough to receive said central web therebetween;

(c) the other of said opposite ends including means for defining a transverse bore extending therethrough and having a width no greater than the distance between said apart-spaced ears, said body having a length corresponding to said predetermined distance so that said transverse bore can be aligned between said transverse holes when said central web is located between said arms of said fork; and (d) means connected with said body for attaching a sling loop to said body intermediate said opposite ends thereof.

2. The device of claim 1, said means for attaching a sling loop including a pedestal and rotatable means for attaching said pedestal to a predetermined one of said sides of said body so that said pedestal is rotatable about an axis of rotation extending transversely with respect to said body, and further including attachment means located on said pedestal for connecting a sling loop to said pedestal.

3. The device of claim 2 wherein said rotatable means includes a swivel pin bore extending transversely through said body intermediate said transverse bore and said fork, and a swivel pin extending within said swivel pin bore.

4. The device of claim 2 wherein said rotatable means includes a swivel pin extending rotatably within said pedestal from said body.

5. The device of claim 4 wherein said attachment means includes a pivot pin defining a pivot axis extending substantially perpendicular to said axis of rotation.

6. The device of claim 5, said body including a pair of laterally apart-spaced longitudinally extending side rails the device further including a first sling loop pivotably attached to said pedestal by said pivot pin, and a second sling loop pivotably connected with said body by said swivel pin.

7. The device of claim 1 wherein said body includes a pair of laterally spaced-apart longitudinally extending side rails, and defines swivel pin bore means for receiving a swivel pin extending laterally between said side rails.

8. The device of claim 7, further comprising a swivel pin extending laterally between said side rails and a sling loop having a neck portion connected with said body by said swivel pin, said neck portion of said sling loop extending between said side rails, and said sling loop being pivotable about said swivel pin with respect to said body.

9. The device of claim 1 wherein both said front mount for a sling loop and said lug are connected with a front sight assembly of said shoulder weapon and said lug includes means for retaining a bayonet.

10. The device of claim 1, said means for attaching a sling loop including a pedestal and means for attaching said pedestal to said body on a selected side thereof, said pedestal including attachment means for connecting a sling to said pedestal.

11. The device of claim 10, said attachment means including a sling loop having a neck pivotably attached to said pedestal, and means included in said pedestal for restricting the extent to which said sling loop is pivotable with respect to said pedestal.

12. A sling attachment device for use in conjunction with a shoulder weapon having a front mount for a sling loop, including a pair of laterally apart-spaced ears, and having a lug spaced longitudinally a predetermined distance apart from said front mount, said lug including a vertical central web and having wider portions located above and below said central web, said sling attachment device comprising:

(a) an elongate body having a pair of opposite ends and a pair of opposite sides;

(b) a fork located at a first of said opposite ends of said body, said fork including a pair of arms separated laterally from one another a distance great enough to receive said central web therebetween;

(c) the other of said opposite ends of said body including means for defining a transverse bore extending therethrough; and (d) a sling loop, pivotably attached to said main body on a selected one of said sides thereof, intermediate said opposite ends, and rotatable about an axis of rotation extending transversely with respect to said body.

13. The device of claim 12 wherein said transverse bore and said fork are separated by a distance corresponding to said predetermined distance so that said bore is in alignment with said sling swivel mount when said fork receives said central web.

14. Apparatus for attaching a front end of a sling to a shoulder weapon, comprising:

(a) a front sight assembly including means for securing said front sight assembly to a front part of said shoulder weapon;

(b) a front mount for a sling loop, located on said front sight assembly on a rear, lower portion thereof, said front mount including a pair of laterally apart-spaced ears including colinear bores extending transversely through said ears;

(c) a lug located on said front sight assembly a predetermined distance longitudinally apart from said front mount, said lug including a central web and wider portions located above and below said central web;

(d) an elongate body having a pair of opposite ends and a pair of opposite sides;

(e) a fork located at a first of said opposite ends, said fork including a pair of arms separated laterally from one another and one of said arms being located on each side of said central web;

(f) the other of said opposite ends defining a transverse bore located between said colinear bores of said ears and including a fastener extending through said bores; and (g) a sling loop, pivotably attached to said body intermediate said opposite ends, said sling loop being pivotable about a pivot axis and rotatable about an axis of rotation extending transversely with respect to said main body.

15. A device for attaching a front end of a sling to a shoulder weapon, comprising:

(a) a front sight assembly including front and rear collar means for extending around a barrel of said shoulder weapon to fasten said front sight assembly to a front part of said shoulder weapon;

(b) an elongate body member having respective front and rear ends and a pair of opposite sides, located on said front sight assembly, said rear end being attached to said rear collar means and said front end being attached to said front collar means; and (c) a sling loop attached to said body intermediate said opposite ends thereof and on a selected side thereof.

16. The device of claim 15, said sling loop being rotatable about an axis of rotation extending transversely of said body.

17. The device of claim 16, said sling loop being pivotable about a pivot axis extending substantially perpendicularly with respect to said axis of rotation.

* * * * *

UNITED STATES PATENT AND TRADEMARK OFFICE

CERTIFICATE OF CORRECTION

PATENT NO. : 4,571,872

DATED : February 25, 1986

INVENTOR(S) : David A. Johnson

It is certified that error appears in the above-identified patent and that said Letters Patent is hereby corrected as shown below:

| | |
|---|---|
| Col. 5, Line 25 | Change "controversial" to --conventional-- |
| Col. 5, Line 29 | After "conventional" insert --military-- |
| Col. 6, Line 8 | Change "placed" to --spaced-- |
| Col. 6, Line 58 | Change "spaced-apart" to --apart-spaced-- |

Signed and Sealed this

Twenty-fifth Day of November, 1986

*Attest:*

DONALD J. QUIGG

*Attesting Officer* *Commissioner of Patents and Trademarks*